US009159259B2

(12) United States Patent
Xu

(10) Patent No.: US 9,159,259 B2
(45) Date of Patent: Oct. 13, 2015

(54) TESTING CIRCUITS OF LIQUID CRYSTAL DISPLAY AND THE TESTING METHOD THEREOF

(71) Applicant: Shenzhen China Star Optoelectronics Technology Co., Ltd., Shenzhen, Guangdong (CN)

(72) Inventor: Liang Xu, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 253 days.

(21) Appl. No.: 13/981,350

(22) PCT Filed: Jun. 24, 2013

(86) PCT No.: PCT/CN2013/077793

§ 371 (c)(1),
(2) Date: Jul. 24, 2013

(87) PCT Pub. No.: WO2014/194539

PCT Pub. Date: Dec. 11, 2014

(65) Prior Publication Data

US 2014/0361805 A1 Dec. 11, 2014

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01)

(58) Field of Classification Search
CPC ..... G09G 3/006
See application file for complete search history.

(56) References Cited

U.S. PATENT DOCUMENTS

| | | | | |
|---|---|---|---|---|
| 6,320,568 | B1 * | 11/2001 | Zavracky | 345/101 |
| 8,937,584 | B2 * | 1/2015 | Kwak et al. | 345/80 |
| 2009/0096770 | A1 * | 4/2009 | Kawabe | 345/204 |
| 2012/0299973 | A1 * | 11/2012 | Jaffari et al. | 345/690 |

* cited by examiner

*Primary Examiner* — Tung X Nguyen
*Assistant Examiner* — Alesa Allgood
(74) *Attorney, Agent, or Firm* — Andrew C. Cheng

(57) ABSTRACT

A device and method for testing a display panel are disclosed. The display panel includes a plurality of pixels arranged in a matrix. Each of the pixels is controlled by a charging gate line and a sharing gate line. The testing circuit includes a first, second, third data testing pad electrically coupling a plurality of red, green, and blue sub-pixels respectively, and k gate testing pad. The sharing gate line of m-th sub-pixel row electrically connects to the charging gate line of (m+2n)-th sub-pixel row, wherein m is a positive integer, and n is the positive integer not less than 2. A row number of the sub-pixel row is divided by k to obtain a remainder q. The q-th gate testing pad electrically connects to the charging gate lines coupled with the sub-pixel row, and k and q are positive integers. And 2n is not divisible by k.

12 Claims, 3 Drawing Sheets

TESTING CIRCUITS OF LIQUID CRYSTAL DISPLAY AND THE TESTING METHOD THEREOF

BACKGROUND OF THE INVENTION

1. Field of the Invention

Embodiments of the present disclosure relate to display technology, and more particularly to a testing circuit of the liquid crystal display (LCD) and the testing method thereof.

2. Discussion of the Related Art

In the LCD manufacturing process, display panels are tested before being mounted with the chip on film (COF) and the PCB. The testing, which are classified according to the probes, includes full contact mode, shorting bar mode, and one gate one date mode.

In the full contact mode, the number of the pins on the probe is basically the same with that of the pins within the terminal area of the display panel, which is of the range between one thousand to several thousands. The electrical waveforms used by the pins are from the generator that is the same with the module PCB. Thus, this testing method is reliable for detecting Mura, defective dots, and defective lines. Also, many detecting frames can also be displayed. However, the probe is expensive and fragile. In addition, the alignment between the probe and the display panel is critical and thus the efficiency is low.

In the shorting bar mode, the pins of the gate terminals are connected to form a short circuit. Generally, the gate terminals in odd rows are connected to form a first testing pad, and the gate terminals in even rows are connected to form a second testing pad. One short connection is established by the data lines coupled with the red sub-pixels to form a third testing pad. Similarly, short connections are between the data lines coupled with the green sub-pixels and the data lines coupled with the blue sub-pixels to form a fourth testing pad and a fifth testing pad. It can be seen that the number of the gate terminals has been decreased, and thus the cost of the probe is low. In addition, the dimension of the testing pad is greatly larger than that of the terminals of the probe. Thus, it is easy to align the probe with the display panel so that the manufacturing efficiency is enhanced. However, only specific frames can be displayed, and the signals provided by the probe is much different from that provided by the module PCB, which causes the testing unreliable.

In the one gate one date mode, after the probe is pressed on the terminal area of the display panel by conductive tape or adhesive, the short connections are between all of the scanning lines, and also between the data lines. The display panel is treated as a sub-pixel with such configuration. The cost of this mode is between the above-mentioned modes. Generally, the one gate one date mode is adopted to be one supplementary detecting method after the shorting bar mode as the fewest frames can be displayed and the precision is low.

Color shift effect is a critical issue for vertical alignment (VA) mode LCDs. A plurality of solutions, such as coupling capacitor (CC) method, dual TFT driving method (TT), and charge sharing method, are provided. For the above modes, one sub-pixel is divided into a main area and a sub area larger than the main area, and this configuration is usually referred to as "8 domain" design.

Within the configuration, each sub-pixel is driven by dual gate lines, including a charging gate line and a sharing gate line as shown in FIG. 1. The gate of the transistors T1, T2 couple to the charging gate line, the source of the transistors T1, T2 couple to the data line D, and the drain of the transistors T1, T2 respectively couple to the electrodes in the main area and the sub area. The gate, source, and drain respectively couple to the sharing gate line, the source of the transistor T2, and one end of the capacitor (Cdown). Another end of the capacitor (Cdown) couples to a shared voltage (Vcom).

The sub-pixel in FIG. 1 may be the red, green, or blue sub-pixel. The pixels formed by the red, the green, and the blue sub-pixel are arranged in a matrix on the display panel. The matrix includes sub-pixel rows and sub-pixel columns The short connection is between the sharing gate line coupled with the m-th sub-pixel row and the charging gate line coupled with the (m+2n)-th sub-pixel row, and the m and n are positive integers.

When performing the testing with the shorting bar mode, the charging gate lines coupling with the odd sub-pixel row form the short connection, and the charging gate lines couple to the first gate testing pad. The charging gate lines coupling with the even sub-pixel row form the short connection, and the charging gate lines couple to the second gate testing pad. As such, the charging gate line and the sharing gate line of the sub-pixels of the same row are at a low voltage level or at a high voltage level at the same time. However, there is a time gap between the turn-on time of the transistor T3 and that of the transistors T1, T2. The defective dots cannot be detected within the time gap. It is to be noted that the defective dots includes dead dot, bright dot, and dark dot. The dead dot relates to a black dot in a white frame or a white dot in a black frame. The black dot relates to a red, green or blue dot in the black frame. The dark dot relates to a dot that is not purely red, green, or blue in the white frame. The number of defective dots is a key factor for evaluating the display performance of the display panel.

SUMMARY

The object of the claimed invention is to provide a testing circuit and a testing method for a display panel. One gate signal is provided to a specific gate testing pad such that the voltage level of the charging gate line and the sharing gate line, which are connected to the corresponding sub-pixels controlled by the specific gate testing pad, are different. In this way, the turn-on time of the transistor T3 is different from that of transistors T1, T2 such that the defective dots can be easily detected.

In one aspect, a testing circuit of a display panel is disclosed. The display panel includes a plurality of pixels arranged in a matrix comprising sub-pixel rows and sub-pixel columns Each of the pixels is controlled by a charging gate line and a sharing gate line. The testing circuit includes: a first data testing pad electrically coupling a plurality of red sub-pixels; a second data testing pad electrically coupling a plurality of green sub-pixels; a third data testing pad electrically coupling a plurality of black sub-pixels; the sharing gate line of m-th sub-pixel row electrically connects to the charging gate line of (m+2n)-th sub-pixel row, and wherein m is a positive integer, and n is the positive integer not less than 2; k gate testing pads, wherein a row number of the sub-pixel row is divided by k to obtain a remainder q, the q-th gate testing pad electrically connects to the charging gate lines coupled with the sub-pixel row, and k and q are positive integers; and wherein 2n is not divisible by k.

Wherein k is not larger than 2n.

Wherein k is 3, and n is 2.

Wherein k is 3, and n is 2.

Wherein the sub-pixels includes two transistors connecting to the charging gate line and the data line, wherein when a turn-on signal is input to one specific charging gate line connected to one corresponding gate testing pad, the transistors coupled with the charging gate line is turn on, and a turn-off signal is input to the charging gate lines coupling with the gate testing pads other than the specific charging gate line, and when data signals are input to the data lines, the gate testing pad controls the sub-pixels to display.

Wherein the sub-pixel further includes one transistor electrically connecting to the sharing gate line, the voltage level of the charging gate line and the sharing gate line of the sub-pixel that are controlled by the specific gate testing pad are different.

In another aspect, a testing method of a display panel, comprising: electrically connecting the data lines coupled with red sub-pixels and electrically coupling a first data testing pad; electrically connecting the data lines coupled with green sub-pixels and electrically coupling a second data testing pad; electrically connecting the data lines coupled with blue sub-pixels and electrically coupling a third data testing pad; electrically connecting a sharing gate line of m-th sub-pixel row to a charging gate line of (M+2n)-th sub-pixel row, and wherein m is a positive integer, and n is the positive integer not less than 2; diving a row number of the sub-pixel row by k to obtain a remainder q, and electrically connecting a q-th gate testing pad to the charging gate line coupled with the sub-pixel row, k and q are positive integers, and 2n is not divisible by k.

Wherein k is not larger than 2n.

Wherein k is 3, and n is 2.

Wherein k is 3, and n is 2.

Wherein the sub-pixels includes two transistors connecting to the charging gate line and the data line, wherein when a turn-on signal is input to one specific charging gate line connected to one corresponding gate testing pad, the transistors coupled with the charging gate line is turn on, and a turn-off signal is input to the charging gate lines coupling with the gate testing pads other than the specific charging gate line, and when data signals are input to the data lines, the gate testing pad controls the sub-pixels to display.

Wherein the sub-pixel further includes one transistor electrically connecting to the sharing gate line, the voltage level of the charging gate line and the sharing gate line of the sub-pixel that are controlled by the specific gate testing pad are different.

DETAILED DESCRIPTION OF THE EMBODIMENTS

Embodiments of the invention will now be described more fully hereinafter with reference to the accompanying drawings, in which embodiments of the invention are shown.

Figure 1:
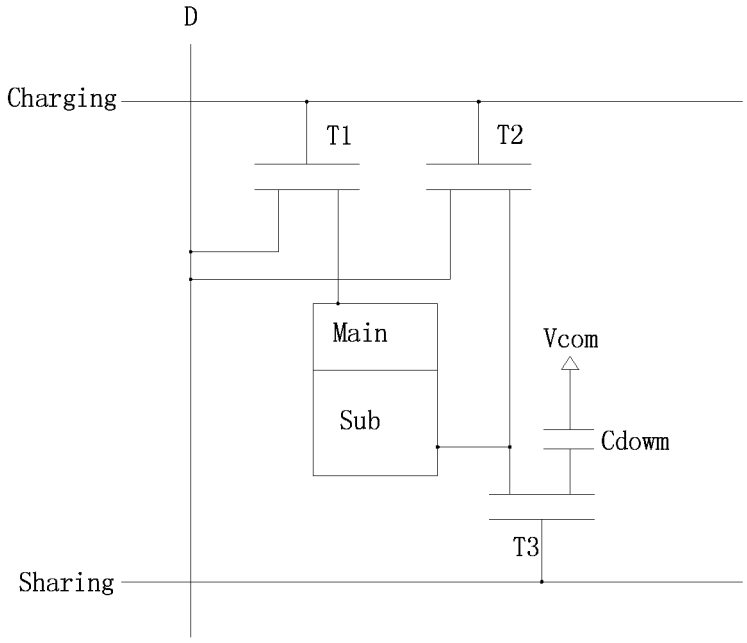
FIG. 1 is a block diagram of the driving circuit of the sub-pixels of the conventional liquid crystal device.
Figure 2:
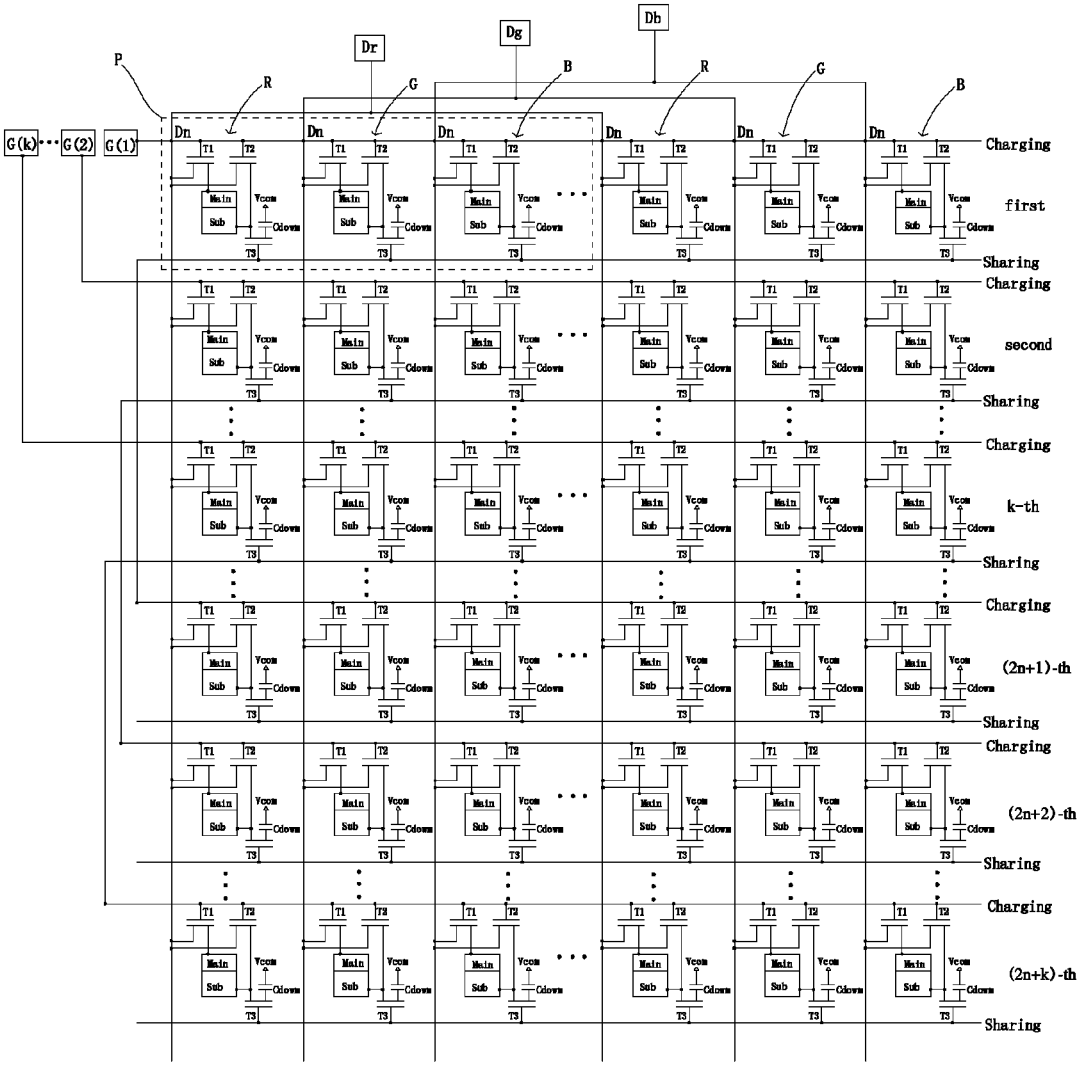
FIG. 2 is a block diagram of the testing circuit of the display panel in accordance with one embodiment.

FIG. 2 is a block diagram of the testing circuit of the display panel in accordance with one embodiment. As shown, the display panel includes a plurality of pixels (P) arranged in a matrix, charging gate lines, sharing gate lines, data lines (Dn), a plurality of gate testing pads G(1), G(2), . . . , G(k), and a first, second, third data testing pads (Dr, Dg, and Db). One pixel (P) includes three sub-pixels having a red sub-pixel (R), a green sub-pixel (G), and a blue sub-pixel (B) as shown in FIG. 1. The data lines (Dn) coupling the red sub-pixel (R) electrically connect to the first data testing pad (Dr). The data lines (Dn) coupling the green sub-pixel (G) electrically connect to the second data testing pad (Dg). The data lines (Dn) coupling the blue sub-pixel (B) electrically connect to the third data testing pad (Db). That is, the first data testing pad (Dr) controls the red sub-pixels (R), the second data testing pad (Dg) controls the green sub-pixels (G), and the third data testing pad (Db) controls the blue sub-pixels (B).

In the matrix of pixels (P), the sharing gate line of m-th sub-pixel row connects to the charging gate line of the (m+2n)-th sub-pixel row. A row number of the sub-pixel row is divided by k to obtain a remainder. For the sub-pixel row with remainder equaling to 1, the charging gate lines coupled with the sub-pixel row are connected, and the charging gate lines electrically connect to the first gate testing pad G(1). For the sub-pixel row with remainder equaling to 2, the charging gate lines coupled with the sub-pixel row are connected, and the charging gate lines electrically connect to the first gate testing pad G(2). It can be conceived that the for the sub-pixel row with remainder equaling to 0, the charging gate lines coupled with the sub-pixel row are connected, and the charging gate lines electrically connect to the first gate testing pad G(k). Wherein the m is a positive integer, n is the positive integer not less than 2, k is the positive integer, and 2n is not divisible by k. In order to decrease the number of the gate testing pads to reduce the cost, preferably, k is not larger than 2n. In this way, the first gate testing pad G(1) controls the sub-pixel row with remainder equaling to 1, and the second gate testing pad G(2) controls the sub-pixel row with remainder equaling to 2. Similarly, the k-th gate testing pad G(k) controls the sub-pixel row with remainder equaling to zero.

During the testing process, a first data signal (d1), a second data signal (d2), a third data signal (d3), a first gate signal (g1), a second gate signal g(2) . . . a k-th gate signal g(k) are respectively input to the first data testing pad (Dr), the second data testing pad (Dg), the third data testing pad (Db), the first gate testing pad G(1), the second gate testing pad G(2), . . . , and the k-th gate testing pad G(k) such that the display panel displays red, green, and blue. As the first gate signal (g1), the second gate signal g(2), . . . , the k-th gate signal g(k) are provided in turn, the level of the charging gate line and the sharing get line coupled by the sub-pixels in each rows are different so as to easily detect defective dots, particularly for those that have not been detected due to a different turn-on time of the transistors (T3, T1, T2).

Figure 3:
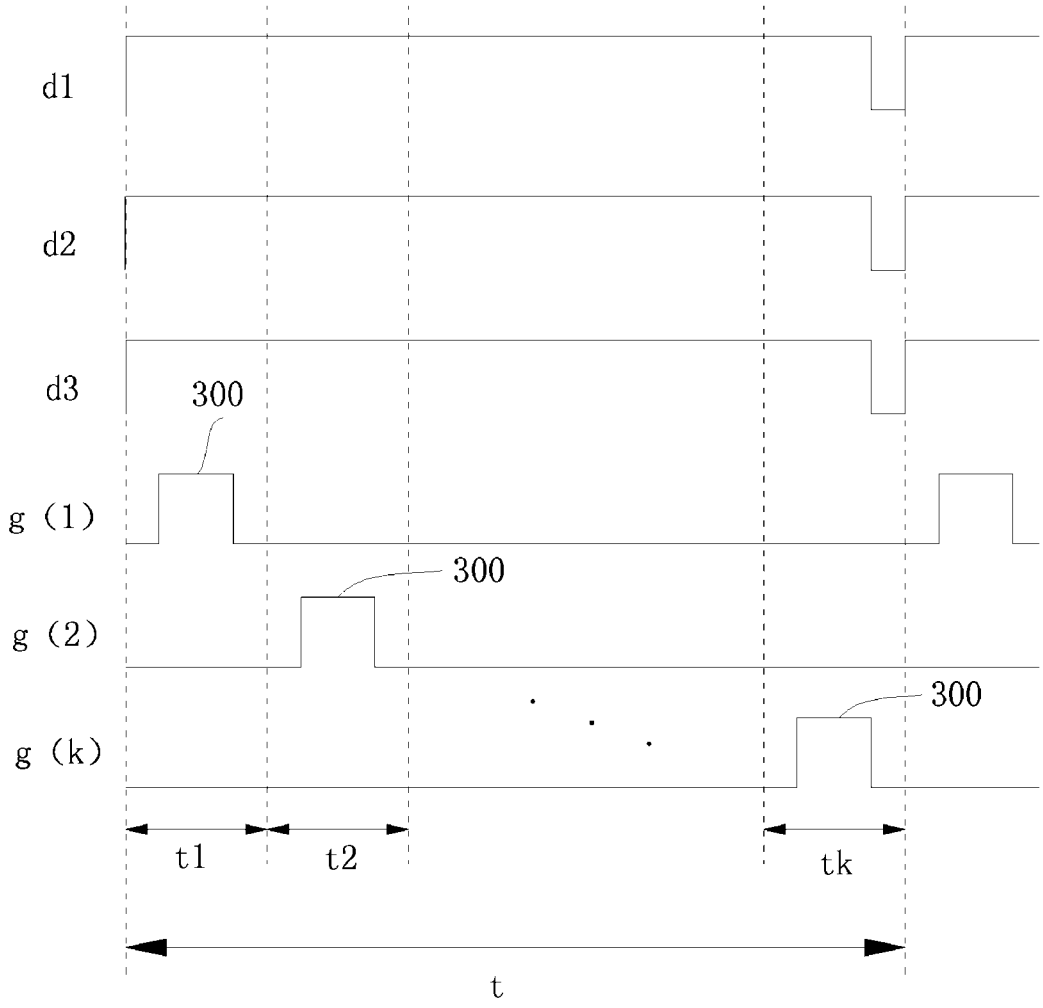
FIG. 3 is a waveform diagram of the display panel of FIG. 2.

In view of the above, the display panel is tested by providing proper signals to the display panel during the testing process. In addition to the testing circuit, a method for testing the display panel is also disclosed. FIG. 3 is a waveform diagram of the display panel of FIG. 2, wherein x-axis represents the change of time, and the y-axis represents the change of voltage.

The method for testing the display panel includes the following steps. Firstly, a first data signal (d1), a second data signal (d2), a third data signal (d3), a first gate signal (g1), a second gate signal g(2) . . . a k-th gate signal g(k) are respectively input to the first data testing pad (Dr), the second data testing pad (Dg), the third data testing pad (Db), the first gate testing pad G(1), the second gate testing pad G(2), . . . , and the k-th gate testing pad G(k). The first data signal (d1), the second data signal (d2), the third data signal (d3), the first gate signal (g1), the second gate signal g(2) . . . the k-th gate signal g(k) are periodic signals with the same time period (t). In addition, the first gate signal (g1), the second gate signal g(2), . . . , the k-th gate signal g(k) are periodic signals having a periodic surge wave 300. The voltage of the surge wave 300 turns on the transistor T1, T2, T3 connected to the first gate testing pad G(1), the second gate testing pad G(2), . . . , and the k-th gate testing pad G(k). When the waveforms of the first gate testing pad G(1), the second gate testing pad G(2), . . . , and the k-th gate testing pad G(k) does not include the surge wave 300, the transistors T1, T2, T3 are turn off. In other words, when the turn-on signals are input to one specific gate testing pad, the charging gate lines electrically connected to the specific gate testing pad are input with the turn-on signals. As such, the transistors T1, T2 coupled with the charging gate lines are turn on. On the other hand, other gate testing pads are input with the turn-off signals. The sharing gate lines coupled with the sub-pixels, which are controlled by the other gate testing pads, electrically connect to other gate testing pads, and the turn-off signals are input to the sharing gate lines. Thus, the voltage level of the charging gate line and the sharing gate line coupled with the sub-pixels controlled by the gate testing pads are different.

The sub-pixels display color when the transistors T1, T2 of the sub-pixels are turn on. The first data signal (d1), the second data signal (d2), the third data signal (d3), the first gate signal (g1), the second gate signal g(2) . . . the k-th gate signal g(k) will be described hereinafter with reference to FIGS. 2 and 3.

At an initial stage of period t1, the sub-pixels are not turn on. When the surge wave 300 of the first gate signal (g1) arises, the charging gate line and the sharing gate line are at the high voltage level such that the transistors T1, T2 coupled with the charging gate lines, which connect to the first gate testing pad G(1), are turn on. The first data testing pad (Dr), the second data testing pad (Dg), the third data testing pad (Db) respectively input the first data signal (d1), the second data signal (d2), the third data signal (d3) to the data lines (Dn). The above data signals are then input to the sub-pixels turn on by the transistors T1, T2. At this moment, the first gate testing pad (G1) controls the sub-pixels to display color. As the surge wave 300 is absent from the second gate signal g(2), . . . , the k-th gate signal g(k), the charging gate line and the sharing gate line respectively connecting to the second gate testing pad G(2), . . . , and the k-th gate testing pad G(k) are at the low voltage level. Thus, the sharing gate line, coupled with the sub-pixels that are turn on by the first gate signal (g1), are also at the low voltage level.

At the initial stage of period t2, the sub-pixels are not turn on. When the surge wave 300 of the second gate signal g(2) arises, the charging gate line and the sharing gate line are at the high voltage level such that the transistors T1, T2 electrically coupled with the second gate testing pad g(2) are turn on. The first data testing pad (Dr), the second data testing pad (Dg), the third data testing pad (Db) respectively input the first data signal (d1), the second data signal (d2), the third data signal (d3) to the transistors T1, T2 of the sub-pixels that are turn on. The second gate testing pad G(2) controls the sub-pixels to display color. As the surge wave 300 is absent from the second gate signal g(2), . . . , the k-th gate signal g(k), the charging gate line and the sharing gate line respectively connecting to the second gate testing pad G(2), . . . , and the k-th gate testing pad G(k) are at the low voltage level . Thus, the sharing gate lines, coupled with the sub-pixels that are turn on by the second gate signal (g2), are also at the low voltage level.

It can be speculated that the sub-pixels are not turn on at the initial stage of period tk. When the surge wave 300 of the k-th gate signal g(k) arises, the charging gate line and the sharing gate line are at the high voltage level such that the transistors T1, T2 coupled with the charging gate lines, which connect to the first gate testing pad G(k), are turn on. The first data testing pad (Dr), the second data testing pad (Dg), the third data testing pad (Db) respectively input the first data signal (d1), the second data signal (d2), the third data signal (d3) to the transistors T1, T2 of the turn-on sub-pixels. The k-th gate testing pad G(k) controls the sub-pixels to display color. As the surge wave 300 is absent from the first gate signal g(1), the second gate signal g(2), . . . , the (k-1)-th gate signal g(k-1), the charging gate line and the sharing gate line respectively connecting to the first gate testing pad G(1), the second gate testing pad G(2), . . . , and the (k-1)-th gate testing pad G(k-1) are at the low voltage level. Thus, the sharing gate lines, coupled with the sub-pixels that are turn on by the k-th testing pad G(K), are also at the low voltage level.

In view of the above, as the gate testing pads are expensive, the testing circuit is simplified in the above embodiments. Preferably, n equals to 2 and k equals to 3. That is, the sharing gate line, which couples with the sub-pixels in the m-th row, connects with the charging gate line coupling with the sub-pixels in the (m+4)-th row. The row number of the sub-pixel row is divided by 3.

For the sub-pixel row with remainder equaling to 1, the charging gate lines coupled with the sub-pixel row are connected, and the charging gate lines electrically connect to the first gate testing pad G(1). For the sub-pixel row with remainder equaling to 2, the charging gate lines coupled with the sub-pixel row are connected, and the charging gate lines electrically connect to the first gate testing pad G(2). For the sub-pixel row with remainder equaling to 0, the charging gate lines coupled with the sub-pixel row are connected, and the charging gate lines electrically connect to the first gate testing pad G(3). In this way, the first gate testing pad G(1) controls the sub-pixel row with remainder equaling to 1, and the second gate testing pad G(2) controls the sub-pixel row with remainder equaling to 2. The third gate testing pad G(3) controls the sub-pixel row with remainder equaling to zero.

In view of the above, the testing circuit and the testing method provide one gate signal to one specific gate testing pad such that the voltage level of the charging gate line and the sharing gate line, which are connected to the corresponding sub-pixels controlled by the specific gate testing pad, are different. In this way, the turn-on time of the transistor T3 is different from that of transistors T1, T2 such that the defective dots can be easily detected.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A testing circuit of a display panel, the display panel comprises a plurality of pixels arranged in a matrix comprising sub-pixel rows and sub-pixel columns, each of the pixels is controlled by a charging gate line and a sharing gate line, comprising:

a first data testing pad electrically coupling a plurality of red sub-pixels;

a second data testing pad electrically coupling a plurality of green sub-pixels;

a third data testing pad electrically coupling a plurality of black sub-pixels;

the sharing gate line of m-th sub-pixel row electrically connects to the charging gate line of (m+2n)-th sub-pixel row, and wherein m is a positive integer, and n is the positive integer not less than 2;

k gate testing pads, wherein a row number of the sub-pixel row is divided by k to obtain a remainder q, the q-th gate testing pad electrically connects to the charging gate lines coupled with the sub-pixel row, and k and q are positive integers; and wherein 2n is not divisible by k.

2. The testing circuit as claimed in claim 1, wherein k is 3, and n is 2.

3. The testing circuit as claimed in claim 1, wherein the sub-pixels comprises two transistors connecting to the charging gate line and the data line, wherein when a turn-on signal is input to one specific charging gate line connected to one corresponding gate testing pad, the transistors coupled with the charging gate line is turn on, and a turn-off signal is input to the charging gate lines coupling with the gate testing pads other than the specific charging gate line, and when data signals are input to the data lines, the gate testing pad controls the sub-pixels to display.

4. The testing circuit as claimed in claim 1, wherein k is not larger than 2n.

5. The testing circuit as claimed in claim 2, wherein k is 3, and n is 2.

6. The testing circuit as claimed in claim 5, wherein the sub-pixel further comprises one transistor electrically connecting to the sharing gate line, the voltage level of the charging gate line and the sharing gate line of the sub-pixel that are controlled by the specific gate testing pad are different.

7. A testing method of a display panel, comprising:

electrically connecting the data lines coupled with red sub-pixels and electrically coupling a first data testing pad;

electrically connecting the data lines coupled with green sub-pixels and electrically coupling a second data testing pad;

electrically connecting the data lines coupled with blue sub-pixels and electrically coupling a third data testing pad;

electrically connecting a sharing gate line of m-th sub-pixel row to a charging gate line of (M+2n)-th sub-pixel row, and wherein m is a positive integer, and n is the positive integer not less than 2;

diving a row number of the sub-pixel row by k to obtain a remainder q, and electrically connecting a q-th gate testing pad to the charging gate line coupled with the sub-pixel row, k and q are positive integers, and 2n is not divisible by k.

8. The testing method as claimed in claim 7, wherein k is 3, and n is 2.

9. The testing method as claimed in claim 7, wherein k is not larger than 2n.

10. The testing method as claimed in claim 9, wherein k is 3, and n is 2.

11. The testing method as claimed in claim 7, wherein the sub-pixels comprises two transistors connecting to the charging gate line and the data line, wherein when a turn-on signal is input to one specific charging gate line connected to one corresponding gate testing pad, the transistors coupled with the charging gate line is turn on, and a turn-off signal is input to the charging gate lines coupling with the gate testing pads other than the specific charging gate line, and when data signals are input to the data lines, the gate testing pad controls the sub-pixels to display.

12. The testing method as claimed in claim 11, wherein the sub-pixel further comprises one transistor electrically connecting to the sharing gate line, the voltage level of the charging gate line and the sharing gate line of the sub-pixel that are controlled by the specific gate testing pad are different.

* * * * *